US009301052B2

(12) United States Patent
Amurgis et al.

(10) Patent No.: US 9,301,052 B2
(45) Date of Patent: Mar. 29, 2016

(54) HEADBAND VARIABLE STIFFNESS

(71) Applicant: VOCOLLECT, INC., Pittsburgh, PA (US)

(72) Inventors: Charles William Amurgis, Mars, PA (US); James David Wahl, Escondido, CA (US)

(73) Assignee: Vocollect, Inc., Pitttsburgh, PA (US)

( * ) Notice: Subject to any disclaimer, the term of this patent is extended or adjusted under 35 U.S.C. 154(b) by 142 days.

(21) Appl. No.: 13/834,851

(22) Filed: Mar. 15, 2013

(65) Prior Publication Data

US 2014/0263493 A1 Sep. 18, 2014

(51) Int. Cl.

| | |
|---|---|
| ***H04R 5/033*** | (2006.01) |
| ***A42B 1/22*** | (2006.01) |
| ***H04R 1/10*** | (2006.01) |

(52) U.S. Cl.

CPC ..... *H04R 5/0335* (2013.01); *A42B 1/22* (2013.01); *H04R 1/105* (2013.01)

(58) Field of Classification Search

CPC ..... A42B 1/22
USPC ..... 2/209, 183, 171, 208, 195.2, 195.5; 381/370, 374, 376, 377, 378, 379
See application file for complete search history.

(56) References Cited

U.S. PATENT DOCUMENTS

| | | | | |
|---|---|---|---|---|
| 1,167,368 | A * | 1/1916 | Adams-Randall | 381/378 |
| 2,237,752 | A * | 4/1941 | Clarke | 379/430 |
| 2,946,860 | A * | 7/1960 | Jansen et al. | 181/129 |
| 3,505,684 | A * | 4/1970 | Hutchinson et al. | 2/209 |
| 4,727,585 | A | 2/1988 | Flygstad | |
| 4,875,233 | A * | 10/1989 | Derhaag et al. | 379/430 |
| 4,972,491 | A * | 11/1990 | Wilcox, Jr. | 381/375 |
| 4,987,592 | A * | 1/1991 | Flagg | 379/430 |
| 5,551,090 | A * | 9/1996 | Thompson | A61F 11/08 128/866 |
| 7,024,013 | B1 * | 4/2006 | Van Dam et al. | 381/376 |

FOREIGN PATENT DOCUMENTS

JP H09233585 A 9/1997

OTHER PUBLICATIONS

Combined Search and Examination Report in Application No. GB1403950.7, Dated Sep. 3, 2014, 5 pages.

* cited by examiner

*Primary Examiner* — Tejash Patel
(74) *Attorney, Agent, or Firm* — Additon, Higgins & Pendleton, P.A.

(57) ABSTRACT

A method and apparatus are provided for allowing a user to change the stiffness of their headband, thus changing the clamping force of the headset. The section properties of the headband equivalent spring, which is a cantilevered beam, are changed by engaging a secondary spring, which is also a shorter cantilevered beam. The change is achieved by manipulating the effective length of the secondary spring, which can be accomplished with a set of clamps. Thus, the stiffness of the headband can be modified to the desire of the user.

15 Claims, 4 Drawing Sheets

HEADBAND VARIABLE STIFFNESS

CROSS-REFERENCE TO RELATED APPLICATIONS

Not applicable.

BACKGROUND OF THE INVENTION

Traditionally, headsets are complicated devices that are created for an average-sized person in the population. Some manufacturers provide a single design headset that is "tuned" to the center of the perspective population. This design leads to a mediocre solution for people that are not part of the center. Some manufacturers have solved this problem by offering a family of headbands to address the different head sizes and shapes of the population. This solution becomes a potential inventory and logistics problem. Further, many headset designs include a mechanism in order to adjust the clamping forces. Other designs use worm gears, cables, linkages, and adjustment knobs. Therefore, a solution is needed that would allow a headset to fit a large percentage of the population and allow the user to change the stiffness of their headband.

SUMMARY

Embodiments of the invention are defined by the claims below, not this summary. A high-level overview of various aspects of embodiments of the invention is provided here for that reason, to provide an overview of the disclosure and to introduce a selection of concepts that are further described below in the detailed description section. This summary is not intended to identify key features or essential features of the claimed subject matter, nor is it intended to be used as an aid in isolation to determine the scope of the claimed subject matter.

Embodiments of the present invention relate generally to a method and apparatus for changing the stiffness of headband resulting in changing the clamping force of the headset.

BRIEF DESCRIPTION OF THE SEVERAL VIEWS OF THE DRAWINGS

Illustrative embodiments of the present invention are described in detail below with reference to the included drawing figures, wherein.

DETAILED DESCRIPTION

Embodiments of the present invention relate generally to a method and apparatus for changing the stiffness of headband resulting in changing the clamping force of the headset. Clamps can move along a path changing the clamping force of the headband when worn by a user. More specifically, section properties of the headband are varied by engaging two springs. The variation changes the effective length of a second spring relative to a first spring by changing the engagement length of the springs. The variation changes the stiffness and resulting clamping force allowing a user to adjust the headband to their comfort.

In a first aspect, a method for changing a stiffness of a headband is provided that includes aligning a primary spring and a secondary spring together. The primary spring and the secondary spring are flexible curved beams. Each spring has a shape of an arc. The primary spring and the secondary spring are shaped to caress and fit against a human head. The primary spring and the secondary spring are joined together with moveable clamps. A member of the moveable clamps is moved along the primary spring and the secondary spring such that the member clamps the primary spring and secondary spring together at that particular point and varies the stiffness of the headband relative to the member being located at a different point along the primary spring and secondary spring. The stiffness of the headband is increased by increasing a spacing between the moveable clamps positioned along the primary spring and the secondary spring.

In another aspect, a method for changing a clamping force to a head of a user is provided that includes elongating a first flexible material and a second flexible material. The first flexible material and the second flexible material are shaped into an arc to fit over the head of the user. The first flexible material is created with a length longer than the second flexible material. The first flexible material and the second flexible material are aligned together. The first flexible material and the second flexible material are clamped together with moveable clamps. The moveable clamps are moved to different positions along the first flexible material and the second flexible material to change a stiffness of the headband.

Figure 1:
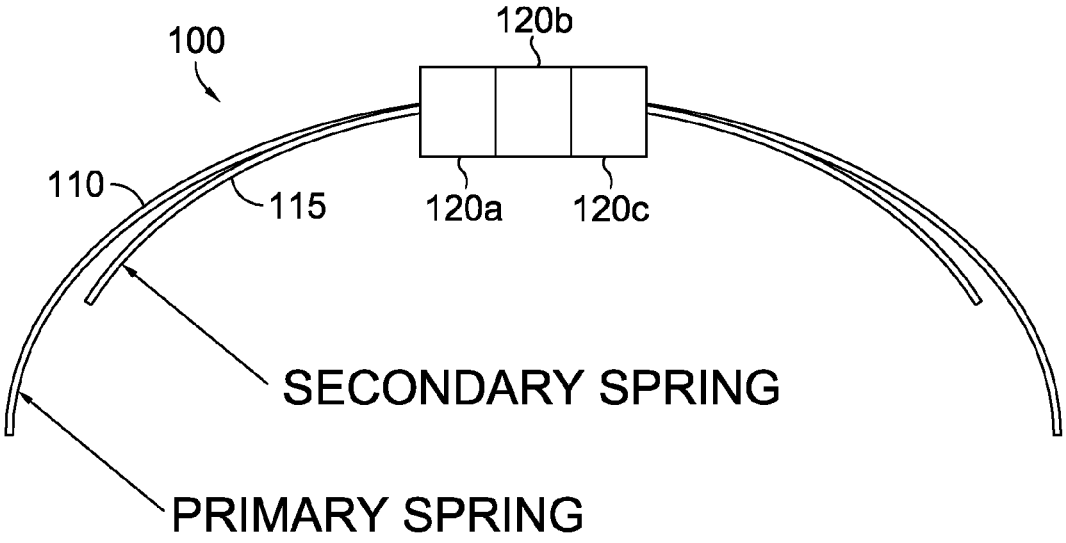
FIG. 1 is an exemplary illustration of a headband with a least amount of clamping force, implemented in accordance with an embodiment of the present invention.

In FIG. 1, a headband 100 is shown with a primary spring 110 and a secondary spring 115 held together with clamps 120*a*, 120*b*, and 120*c*. Primary spring 110 and secondary spring 115 can also be cantilevered beams. As shown in FIG. 1, primary spring 110 and secondary spring 115 have curved shapes in the form of an arc. These shapes are created in order to allow primary spring 110 and secondary spring 115 to fit around a human head.

Figure 2:
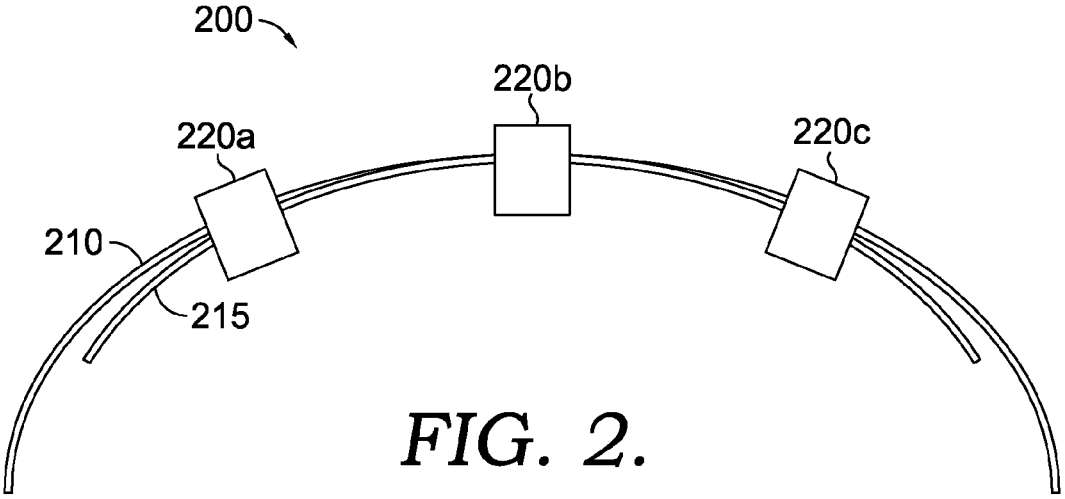
FIG. 2 is an exemplary illustration of a headband with a significant amount of clamping force, implemented in accordance with an embodiment of the present invention.

In FIG. 2, a headband 200 is shown as an alternate illustration to headband 100 in FIG. 1. Headband 200 includes a primary spring 210 and a secondary spring 215 clamped together similar to primary spring 110 and secondary spring 115 in FIG. 1. However, clamps 220*a*, 220*b*, and 220*c* are shown spaced apart from one another. Claims 220*a*, 220*b*, and 220*c* are similar to clamps 120*a*, 120*b*, and 120*c*, but the illustration between FIGS. 1 and 2 indicate that the clamps can move or slide across the springs into different positions.

Figure 3:
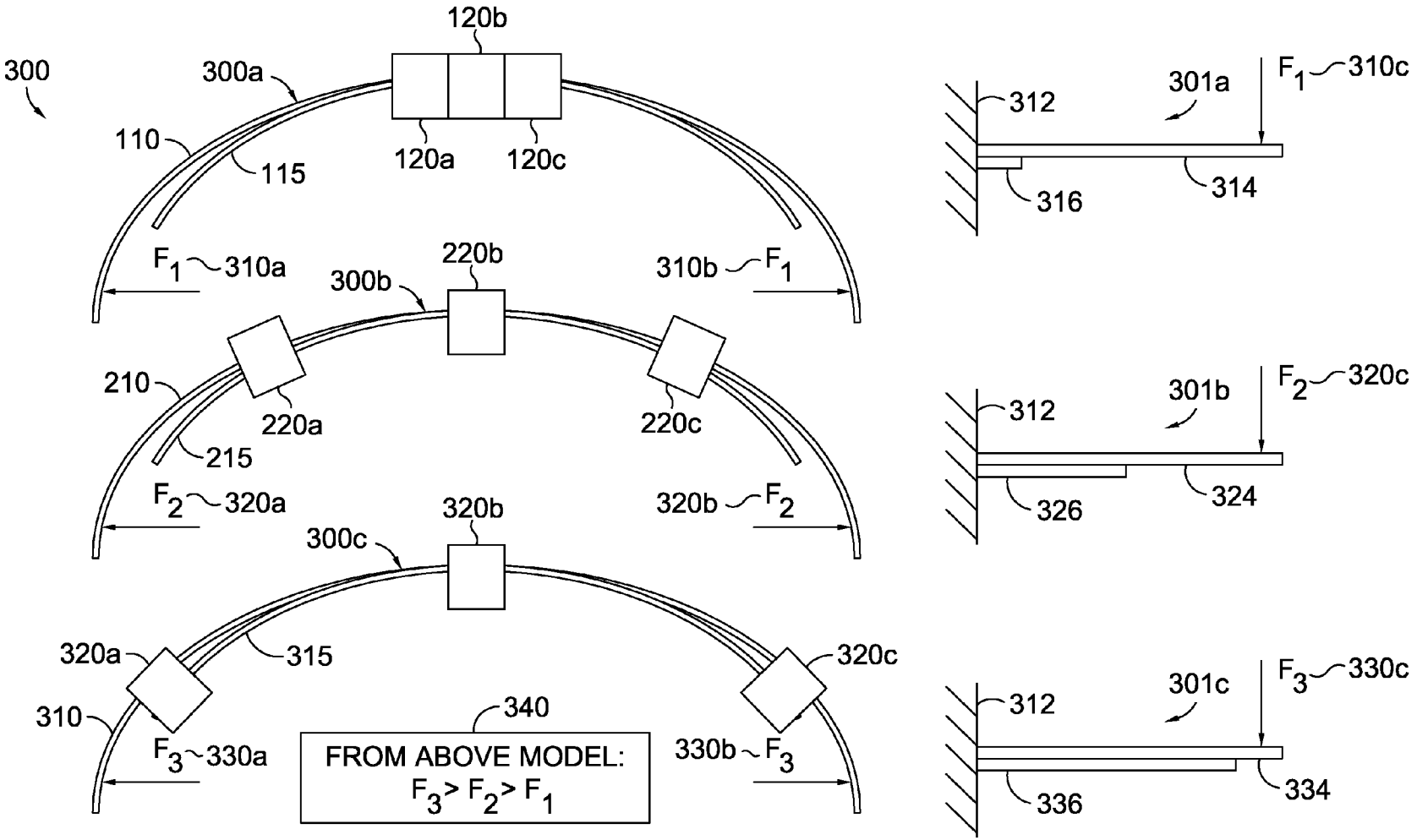
FIG. 3 is an exemplary illustration of headbands with varying amounts of clamping force, implemented in accordance with an embodiment of the present invention.

Turning now to FIG. 3, several headbands are shown with the clamps in different positions. Headband 300*a* is similar to headband 100 in FIG. 1. As depicted, headband 300*a* shows clamps 120*a*, 120*b*, and 120*c* positioned together. With the position of clamps 120*a*, 120*b*, and 120*c*, forces 310*a* and 310*b* will occur as shown on primary spring 110. The illustration of forces 310*a* and 310*b* on primary spring 110 can be seen in an equivalent spring representation 301*a*. Representation 301*a* shows a representation of a clamp in the form of a stationary clamp 312. From stationary clamp 312, a first beam 314 is shown with a second beam 316. A force 310*c* can be applied to first beam 314, which represents forces 310*a* and 310*b* applied to primary spring 110. As one of ordinary skill in the art knows, the forces can become greater as the length of second beam 316 increases.

Continuing with FIG. 3, headband 300*b* is another representation of headband 300*a* with clamps 220*a*, 220*b*, and 220*c* spaced apart from one another in relation to clamps 120*a*, 120*b*, and 120*c*. Headband 300*b* is similar to headband 200 in FIG. 2. As a result of the spacing between clamps 220*a*, 220*b*, and 220*c*, forces 320*a* and 320*b* occur at primary spring 210. Forces 320*a* and 320*b* are different and stronger than forces 310*a* and 310*b* by virtue of the movement of clamps 220*a*, 220*b*, and 220*c* to their position. This change in force can be seen in representation 301*b* where a first beam 324 is the same as first beam 314. However, a second beam 326 is shown longer relative to second beam 316. Because of the longer second beam 326, force 320*c* is stronger than force 310*c*, resulting in a greater stiffness in headband 300*b* relative to headband 300*a*.

Headband 300*c* is another depiction of headbands 300*a* and 300*b* with clamps 320*a*, 320*b*, and 320*c* moved further apart relative to clamps 220*a*, 220*b*, and 220*c* and clamps 120*a*, 120*b*, and 120*c*. Headband 300*c* has a primary spring 310 and a secondary spring 315 that work together to vary the force and stiffness. Forces 330*a* and 330*b* occur as a result in the change of position of clamps 320*a*, 320*b*, and 320*c*. Because clamps 320*a*, 320*b*, and 320*c* are spaced apart relative to clamps 220*a*, 220*b*, and 220*c*, forces 330*a* and 330*b* will be greater than forces 320*a* and 320*b*. The result is that headband 300*c* will have a greater stiffness than headbands 300*b* and 300*a*. This greater force and stiffness is shown in representation 301*c* where a first beam 334 is the same in length and size to first beams 314 and 324. However, a second beam 336 is much longer in length relative to second beams 316 and 326. As a result, force 330*c* placed on first beam 334 is greater than force 320*c* placed on first beam 324, which is greater than force 310*c* placed on first beam 314. Equation 340 illustrates this point by showing forces 330*a*, 330*b*, and 330*c*, greater than forces 320*a*, 320*b*, and 320*c*, which are greater than forces 310*a*, 310*b*, and 310*c*.

One of ordinary skill in the art knows that by varying the positions of the clamps, the clamping force and stiffness of the headband can be changed. More particularly, the idea here illustrates that moving the clamps to different positions along the springs in the headbands result into different stiffness of the headbands as well as different clamping forces. Although the headbands in FIGS. 1, 2, and 3 are shown with headbands with three clamps, other embodiments of the present inventions can be implemented with more or less number of clamps in the headbands. The present invention can be implemented with two clamps in the headbands. Or, the present invention can be implemented with four or more clamps in the headbands.

Implementations of embodiments of the present invention allow for headsets to be designed to fit a worldwide end user percentile range of five percent (5%) female to ninety-five (95%) male. The design of the headsets can be pleasing to the user by reducing the need for worm gears, cables, linkages, and adjustment knobs. Further, the present invention focuses on providing flexibility, stability, and comfort to a wide range of users. To achieve a present invention with a broad reach, a stiffness equation is considered that can be expressed as the following:

$$\text{Stiffness}=3E*I/l^3,$$

where E is the elastic modulus of the spring (material property), I is the bending moment of inertia, and l is the length of the beam. I is also a function of the width (b) and thickness (h) of the cross section of the spring or beam, and the equation can be further expressed as follows:

$$\text{Stiffness}=(3E*b*h^3)/(12*l^3) \text{ or Stiffness}=E*b*h^3/4*l^3$$

Figure 4:
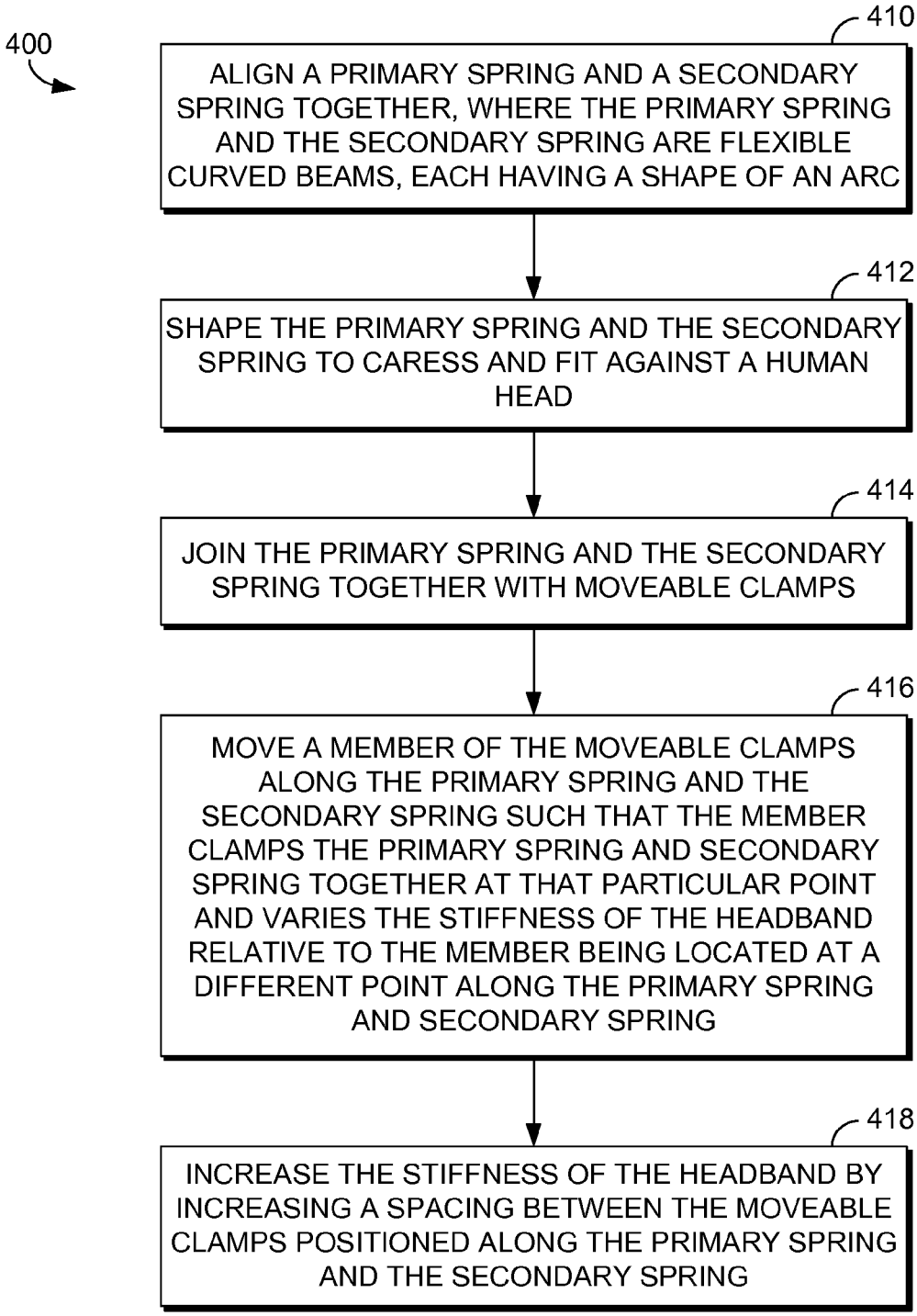
FIG. 4 is a process for changing a stiffness of a headband, implemented in accordance with an embodiment of the present invention.

Turning now to FIG. 4, a method for changing a stiffness of a headband is provided in a process 400. In a step 410, a primary spring 210 and a secondary spring 215 are aligned together. Primary spring 210 and secondary spring 215 are flexible curved beams and have the shape of an arc. In a step 412, primary spring 210 and secondary spring 215 are shaped to caress and fit against a human head. Primary spring 210 and secondary spring 215 are joined together with moveable clamps 220*a*, 220*b*, and 220*c*, in a step 414. In a step 416, a member of moveable clamps 220*a*, 220*b*, and 220*c* is moved along primary spring 210 and secondary spring 215 such that the member clamps primary spring 210 and secondary spring 215 together at a particular point and varies the stiffness of headband 200 relative to the member being located a different point along primary spring 210 and secondary spring 215. In a step 418, the stiffness of headband 200 is increased by increasing spacing between moveable clamps 220*a*, 220*b*, and 220*c* positioned along primary spring 210 and secondary spring 215.

Figure 5:
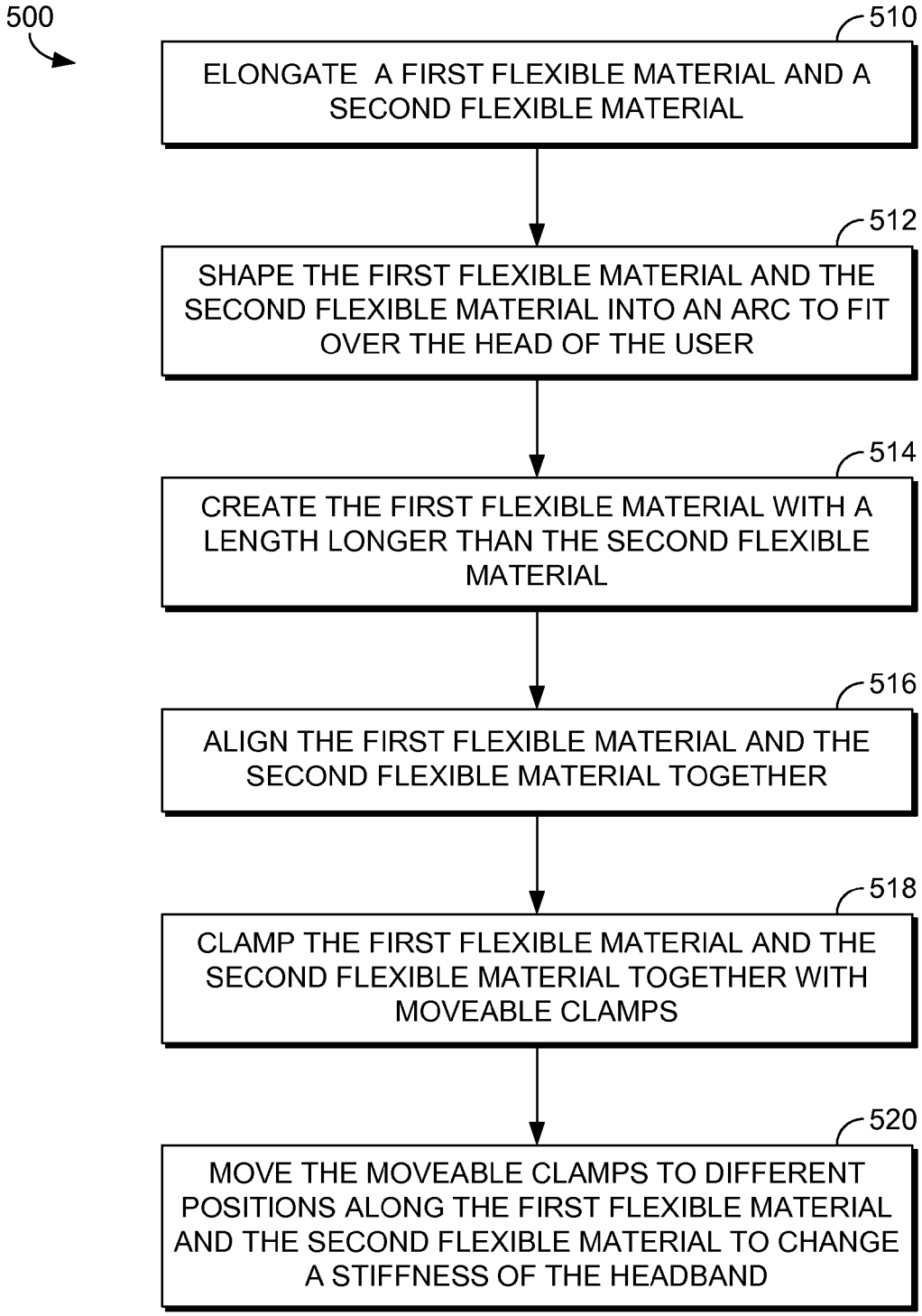
FIG. 5 is a process for changing a clamping force to a head of a user, implemented in accordance with an embodiment of the present invention.

In FIG. 5, a method for changing a clamping force to a head of a user is provided in a process 500. In a step 510, a first flexible material 310 and a second flexible material 315 are elongated in a headband 300*c*. In a step 512, the first flexible material 310 and the second flexible material 315 are shaped into an arc to fit over the head of a user. The first flexible material 310 is created with a length longer than the second flexible material 315, in a step 514. In a step 516, the first flexible material 310 and the second flexible material 315 are aligned together. In a step 518, the first flexible material 310 and the second flexible material 315 are clamped together with moveable clamps 320*a*, 320*b*, and 320*c*. Moveable clamps 320*a*, 320*b*, and 320*c* are moved to different positions along the first flexible material 310 and the second flexible material 315 to change a stiffness in headband 300*c*, in a step 520.

Many different arrangements of the various components depicted, as well as components not shown, are possible without departing from the spirit and scope of embodiments of the present invention. Embodiments of the present invention have been described with the intent to be illustrative rather than restrictive. Certain features and subcombinations are of utility and may be employed without reference to other features and subcombinations and are contemplated to be within the scope of the claims.

The invention claimed is:

1. A method for changing a stiffness of a headband, comprising aligning a primary spring and a secondary spring together, wherein the primary spring and the secondary spring are flexible curved beams, each having a shape of an arc, and wherein the primary spring and the secondary spring are shaped to caress and fit against a human head;

joining the primary spring and the secondary spring together with two or more moveable clamps;

moving a member of the two or more moveable clamps along the primary spring and the secondary spring such that the member clamps the primary spring and secondary spring together at that particular point and varies the stiffness of the headband relative to the member being located at a different point along the primary spring and secondary spring; and increasing the stiffness of the headband by increasing a spacing between the two or more moveable clamps positioned along the primary spring and the secondary spring.

2. The method of claim 1, wherein the primary spring and the secondary spring are cantilevered beams.

3. The method of claim 1, wherein the primary spring and the secondary spring are made from a rigid polyurethane composite.

4. The method of claim 1, wherein moving the member of the two or more moveable clamps comprises sliding the member of the two or more moveable clamps along the primary spring and the secondary spring such that the primary spring and secondary spring connect together along a path between the member and another member of the two or more moveable clamps.

5. A headband that enables a user to change a stiffness that results in changing a clamping force to a head of the user, comprising:

a first flexible material and a second flexible material that are elongated and shaped in an arc to fit over the head of the user;

the first flexible material having a length longer than the second flexible material;

the first flexible material and the second flexible material aligned together, and clamped together with two or more moveable clamps, wherein the two or more moveable clamps can slide along the first flexible material and the second flexible material when aligned together; and the two or more moveable clamps operable to change the stiffness of the headband when located in different positions along the first flexible material and the second flexible material.

6. The headband of claim 5, wherein the stiffness is increased when a spacing between the two or more moveable clamps is increased.

7. The headband of claim 5, wherein the stiffness is decreased when a spacing between the two or more moveable clamps is decreased.

8. The headband of claim 5, wherein the first flexible material and the second flexible material are cantilevered beams.

9. The headband of claim 5, wherein the first flexible material and the second flexible material are made from a rigid polyurethane composite.

10. A method for changing a clamping force to a head of a user, comprising:

elongating a first flexible material and a second flexible material;

shaping the first flexible material and the second flexible material into an arc to fit over the head of the user;

creating the first flexible material with a length longer than the second flexible material;

aligning the first flexible material and the second flexible material together;

clamping the first flexible material and the second flexible material together with two or more moveable clamps; and moving the two or more moveable clamps to different positions along the first flexible material and the second flexible material to change a stiffness of the headband.

11. The method of claim 10, wherein clamping the first flexible material and the second flexible material together with two or more moveable clamps comprises sliding the two or more moveable clamps along the first flexible material and the second flexible material when aligned together.

12. The method of claim 11, wherein the stiffness is increased when a spacing between the two or more moveable clamps is increased.

13. The method of claim 11, wherein the stiffness is decreased when a spacing between the two or more moveable clamps is decreased.

14. The method of claim 11, wherein the first flexible material and the second flexible material are cantilevered beams.

15. The method of claim 11, wherein the first flexible material and the second flexible material are made from a rigid polyurethane composite.

* * * * *